United States Patent [19]

Adler

[11] 4,059,397

[45] Nov. 22, 1977

[54] ROTARY KILN

[76] Inventor: Josef Adler, Pinkmuhlenweg 16, 6101 Nieder-Ramstadt, Germany

[21] Appl. No.: 678,642

[22] Filed: Apr. 20, 1976

[30] Foreign Application Priority Data

May 2, 1975 Germany ..... 2519458

[51] Int. Cl.[2] ..... F27D 15/02

[52] U.S. Cl. ..... 432/80; 432/251

[58] Field of Search ..... 432/80, 251, 103

[56] References Cited

U.S. PATENT DOCUMENTS

| | | | |
|---|---|---|---|
| 1,791,282 | 2/1931 | Parker | 432/80 |
| 3,794,462 | 2/1974 | Sylvest | 432/80 |
| 3,975,147 | 8/1976 | Vering et al. | 432/80 |

*Primary Examiner*—John J. Camby

*Attorney, Agent, or Firm*—Strauch, Nolan, Neale, Nies & Kurz

[57] ABSTRACT

A rotary kiln has a multiplicity of uniformly spaced satellite cooler tubes mounted on its casing by an annular support having flexibly interconnected inner and outer zones.

15 Claims, 8 Drawing Figures

ROTARY KILN

This invention relates to rotary kiln having a number of satellite cooler tubes uniformly distributed round its casing at its outlet end and mounted on the rotary kiln by annular supports affixed to the kiln casing.

In a known construction of rotary kilns, individual satellite cooler tubes are each affixed by a separate support to the kiln casing. This means that during rotation of the kiln the positions of attachment of the individual cooler tube supports to the kiln casing are subjected to greatly varying stresses, which very often lead to undesirable damage to the kiln casing and to breakage of the cooler tube supports.

It is also known for the satellite cooler tubes in the area of at least one section of length to be mounted on annular supports affixed directly to the rotary kiln casing, and having at their periphery recesses that receive the individual satellite cooler tubes, each tube being then fixed by loop-shaped elements to the annular support. A serious disadvantage of these known constructions is that the individual satellite cooler tubes of a rotary kiln, which are often subject to differing loads and thermal expansions, cannot move or cannot do so with sufficient independence from each other. Also undesired restraining forces frequently occur in the case of cooler tube stresses.

The invention is therefore based on the problem of providing a rotary kiln of the type wherein relatively simple constructional features provide a stable cooler tube support which permits firstly a uniform distribution of load on the corresponding section of kiln casing and secondly an adequately high degree of freedom for the individual satellite cooler tubes.

According to the invention this problem is substantially solved in that each support has inner and outer annular zones which are resiliently flexibly connected together in the radial direction and between which are disposed the satellite cooler tubes.

In a construction provided by the invention, the stresses caused by the satellite cooler tubes are predominantly uniformly distributed over the entire periphery of the kiln casing, so that the individual satellite cooler tubes cannot cause damage to that casing. The satellite cooler tubes can be held by the outer annular zone of an annular support in a manner which is statically extremely favorable and thus extremely simple in design; and due to the elastically resilient connections the individual cooler tubes nevertheless have adequate relative movement.

With the construction of annular supports provided by the invention, each having inner and outer annular zones, the distance of the cooler tube central axis from the kiln axis can be made as large as desired within certain limits, which leads to the further advantage that the satellite cooler tubes can be placed at a relatively large spacing from the kiln casing, so that a considerably improved cooling effect can be achieved for the individual cooler tubes.

Further details of the invention will appear from the claims and from the following description of some embodiments shown in the drawings in which:

Figure 1:
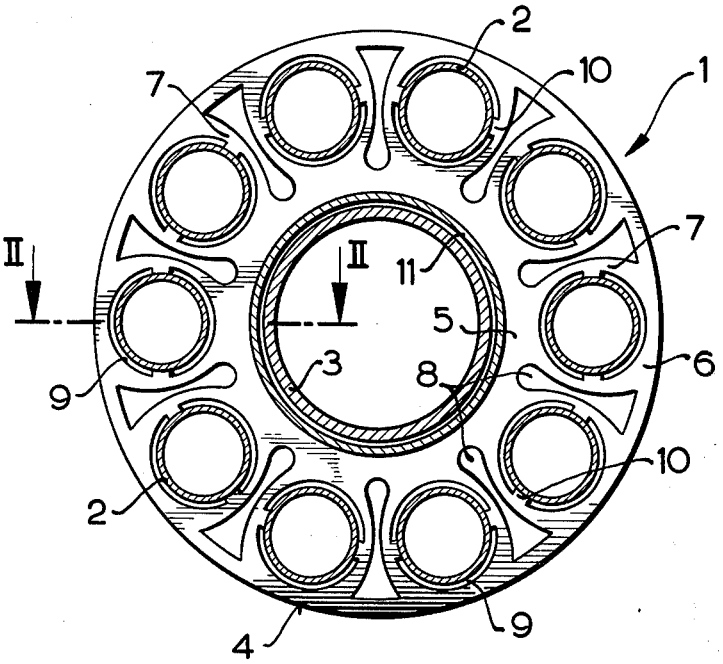
FIG. 1 is a cross-sectional plan view through the outlet end of a rotary kiln according to a first embodiment of the invention.

The embodiments shown in the drawings in accordance with the invention each have ten satellite cooler tubes distributed round the casing at the kiln outlet end; but it will be understood that any other suitable number of cooler tubes could be chosen. Since the design of the satellite cooler tubes themselves forms no part of the actual invention, and these tubes run longitudinally of the kiln casing in the usual manner the kiln constructions in accordance with the invention are each shown only as cross-sectional views.

On the rotary kiln 1 shown in FIG. 1, there are ten satellite cooler tubes 2 disposed with uniform circumferential spacing round the outlet end of the annular kiln casing 3 and at equal distances from casing 3. For affixing and sealing the satellite cooler tubes 2 on the kiln casing 3 there is shown an annular support 4. There are preferably provided two such supports 4 spaced longitudinally of the kiln for mounting the satellite cooler tubes 2 on the kiln casing 3. Each annular support 4 has an inner annular zone 5 and an outer annular zone 6, which zones in this embodiment are integrally joined together by radial struts 7 disposed between each pair of adjacent satellite cooler tubes in the peripheral direction, with each strut having a slot 8 running substantially radially of the rotary kiln 1 and widened at its radially outer and inner ends, hence producing a resiliently yielding connection between the inner annular zone 5 and the outer annular zone 8, because of the slotted radial struts 7. The support 4 is thus of disc construction and can be made from a single sheet metal plate.

Each two adjacent radial struts 7 in the peripheral direction of the rotary kiln, together with the corresponding adjacent sections of the inner annular zone 5 and outer annular zone 6 define an aperture 9 which is preferably substantially circular, and surrounds the corresponding satellite cooler tube 2 at a distance. This distance of spacing is large enough to allow adequate movement of each satellite cooler tube 2 radially of its corresponding aperture. In order to affix a cooler tube 2, in the embodiment shown, the edge which defines the aperture 9 is provided with two generally diametrally opposite projections 10, which if desired can be screwed to corresponding projections (not shown) on the cooler tube casing. Instead of the projections 10 it may be sufficient if projections are only provided on the casing of a satellite cooler tube and can be screwed to adjacent surfaces of the radial struts 7, so that in any case there is a resilient support or mounting for the satellite cooler tube 2.

Figure 2:
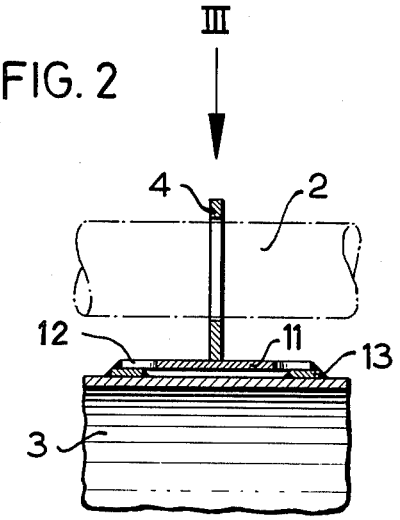
FIG. 2 is a cross-sectional view on line II—II of FIG. 1.
Figure 3:
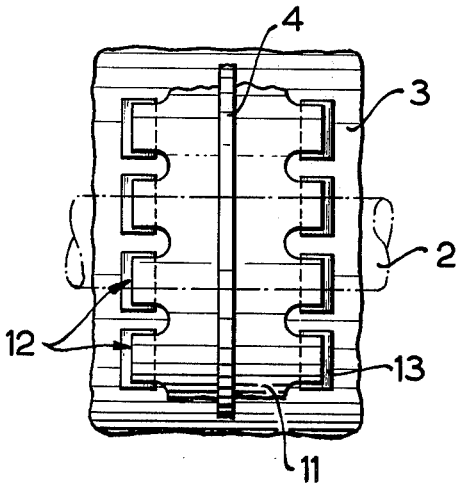
FIG. 3 is a partial plan view in the direction of arow III in FIG. 2.

The annular support 4 shown in FIG. 1 can be affixed directly to the casing 3 of the rotary kiln 1. In many cases it is however beneficial if this annular support is resiliently mounted on the kiln casing 3. A suitable resilient mounting for the support 4 is shown in more detail in the partial views in FIGS. 2 and 3.

On the outside of kiln casing 3 there is provided a short annular length of pipe 11 which at both ends is of toothed or comb construction (at 12), and the tooth- or tine-like members at 12 extending longitudinally and being welded to the kiln casing 3 through metal washer members 13, i.e. with a small spacing. The annular support 4 thus has its inner surface welded to the outside of pipe length 11, and due to resiliency at 11 provides a resilient mounting of the annular support 4 on the kiln casing 3. This type of tubular member 11 may not surround the kiln casing 3 as a one-piece member, but may comprise a number of portions disposed at circumferentially spaced intervals around the periphery, whereby an equivalent resilient mounting can then be produced.

Figure 4:
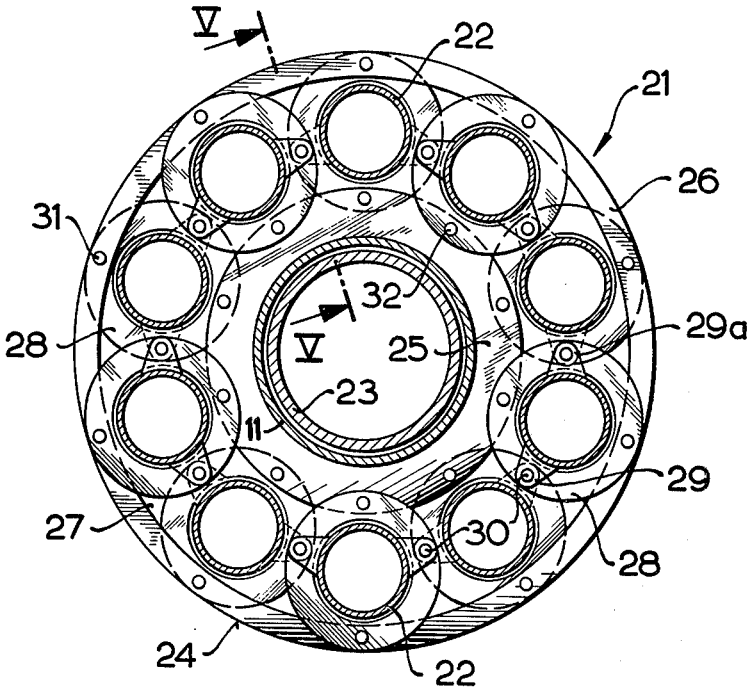
FIG. 4 is a cross-sectional plan view similar to FIG. 1, but illustrating a second embodiment of the invention.

FIG. 4 shows another embodiment of the invention, wherein the casing 23 of the rotary kiln 21 and the number and design of satellite cooler tubes 22 correspond in general to those of FIG. 1. However in this case the inner and outer annular zones of each annular support 24 for the satellite cooler tubes 22 is formed from separate disc rings, i.e. an inner disc ring 25 and outer disc ring 26 which lie substantially coaxial with each other and in a plane perpendicular to the kiln axis. Here the outer disc ring 26 surrounds the inner disc ring 25 with a spacing whereby between these disc rings 25, 26 there is formed a gap whose radial size relative to the kiln is somewhat greater than the outer diameter of the individual satellite cooler tubes 22 so that the latter can be disposed in and extends through these gaps 27.

In the vicinity of the annular support 24 each separate satellite cooler tube 22 has a corresponding disc ring 28 which surrounds the outer casing of the cooler tube in spaced relation with a small gap. This disc ring 28 is joined to the corresponding peripheral section of its satellite cooler tube 22 by two fixed projections 29, **29*a* welded on to the exterior of the cooler tube, and these projections are flexibly connected to the disc ring 28 as by screws 30, as will be explained in more detail below. While on the one hand the disc ring 28 is connected in the manner described to the outside of the corresponding satellite cooler tube 22, it also may have a screw connection (screws 31, 32) to the outer disc ring 26 and the inner disc ring 25, both of which it overlaps sufficiently. In this manner there is thus provided an adequately resilient connection firstly between the inner disc ring 25 and the outer disc ring 26, and secondly between the disc ring 28 and the corresponding satellite cooler tube 22. The inner and outer disc rings 25 and 26 can therefore have a relatively small rectangular cross-section without affecting the all-over stability of the support 24**.

As clearly shown in FIG. 4, the disc rings 28 provided on the cooler tube exterior of cooler tubes 22 adjacent each other peripherally of the kiln are affixed alternately to one side and then the other of the inner and outer disc rings 25 and 26 as seen in the axial direction of the kiln. This arrangement firstly ensures that the satellite cooler tubes 22 can be disposed relatively close to each other around the periphery while maintaining sufficient intervals, and secondly means that a particularly resilient construction of the support 24 can be achieved in this area.

Figure 5:
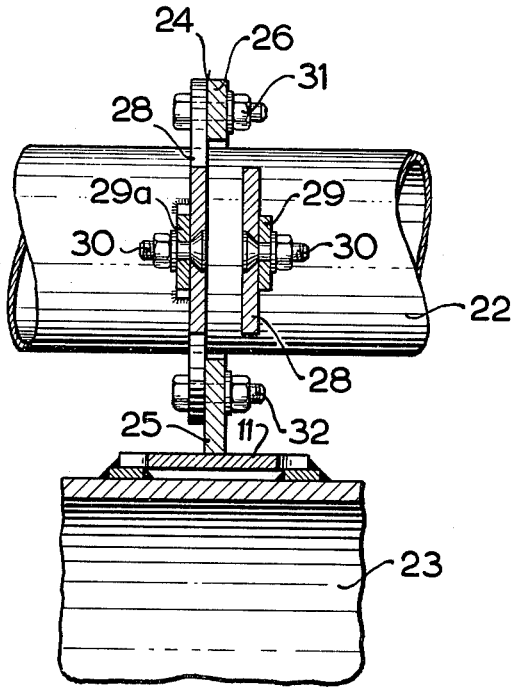
FIG. 5 is a partial cross-section along the line V—V in FIG. 4.

In the sectional view FIG. 5, it may clearly be seen how a satellite cooler tube 22 is connected to its corresponding disc ring and how the latter is connected to the inner disc ring 25 and outer disc ring 26. On its outside the satellite cooler tube 22, shown only in part, has welded-on projections 29, **29*a* which are releasably connected, e.g. by countersunk screws 30, to the associated disc ring 28. Only one of the projections 29*a* in FIG. 5 is on the cooler tube 22 shown, while the projection 29** which is visible is on the adjacent and not shown satellite cooler tube.

In many cases it is also possible, instead of the separate attachments for each satellite cooler tube, for the overlapping disc ring portions to be connected by common screw bolts (as seen in FIGS. 4 and 5); and a spacer washer can then be provided between the overlapping portions of disc ring. With this type of cooler tube fixation however, the individual tubes are more rigidly connected together.

The attachment of the inner disc ring 25 to the kiln casing 23 could also be made rigid, e.g. by welding on to the casing 23. But again with this embodiments the preference is for a resilient mounting of the support 24 on the kiln casing 23 (FIG. 5), which can be provided on an element 11 in similar manner to that described in relation to FIGS. 2 and 3, so making further description of this arrangement unnecessary.

With the two embodiments of the invention described previously, the annular holders 4 and 24 are each circular, i.e. the annular holder 4 in FIG. 1 is generally speaking a one-piece circular disc, while in the FIG. 4 embodiment a plurality of circular discs, i.e. the inner disc ring 25, outer disc ring 26 and intermediate disc ring 28 are provided; and each circular disc can be made from a single-walled plate. In order to achieve more stable support, e.g. with larger types of kiln, at least part of the said circular rings in an annular support may be formed as multi-walled lamellar constructions.

In a rotary kiln constructed in accordance with the invention, the annular support may also be made as a polygonal ring, or at least one annular zone of the support may comprise a polygonal ring.

Figure 6:
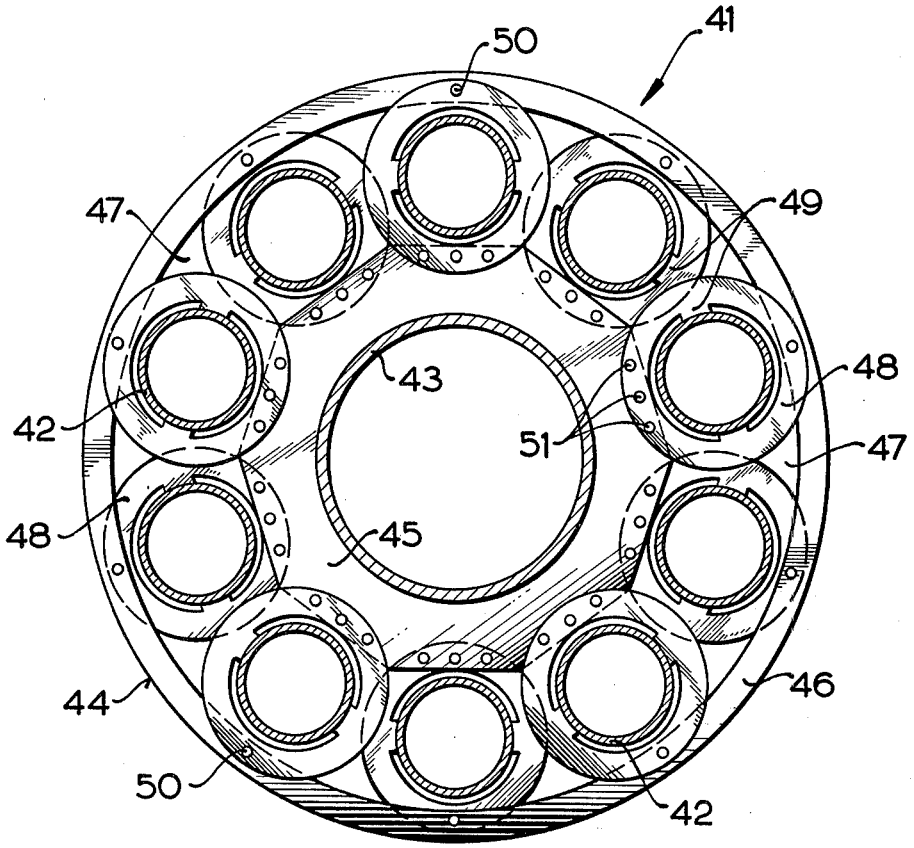
FIG. 6 is a cross-sectional plan view of a rotary kiln similar to FIGS. 1 and 4, but showing a third embodiment.

FIG. 6 shows an embodiment in accordance with the invention of a rotary kiln 41 on whose casing 43 is provided an annular support 44 which in manner similar to the FIG. 4 embodiment has an inner disc ring 45 and outer disc ring 46, disposed coaxially of each other with a gap 47 between them so that the satellite cooler tubes 42 can extend through these gaps 47; and for each support 44 there is again a disc ring mounted on the casing with a gap, so that the satellite cooler tubes 42 are resiliently joined to the inner and outer rings 45, 46 to each other.

While the outer disc ring 46 is formed as a circular ring in the same manner as with the preceding embodiments, the inner disc ring 45 has the external shape of a polygonal ring, with the polygonal surfaces on the periphery each lying beneath a satellite cooler tube 42: the inner surface of the inner disc ring 45 is however made circular to match the kiln casing 43.

The disc ring 48 provided on the casing of the satellite cooler tubes 42 may be affixed to the exterior of the cooler tubes in the same manner as in the FIG. 4 embodiment. In this case it is however preferred to fix the satellite cooler tubes 42 to projections 49 extending inwardly from the inner side of the disc rings 48. Again the disc rings 48 adjacent each other in the peripheral direction are not in this case joined together; but the rings 48 are each flexibly connected by a screw 50 to the outer disc ring 46 and by three screws 51 to the inner disc ring 45.

The outer disc ring 46 need not necessarily be of circular shape, but could also have the form of a polygonal ring to match the inner disc ring, so that corresponding straight peripheral surfaces of the inner disc ring 45 and outer disc ring would lie opposite each other at each tube 42.

In the rotary kiln construction provided by the invention the annular supports could vary in many more ways from the examples given above. Thus in the constructional embodiment of the annular support it is also possible to build them up from segment-like elements, and these elements in turn may if desired be of multilamellar construction.

Figure 7:
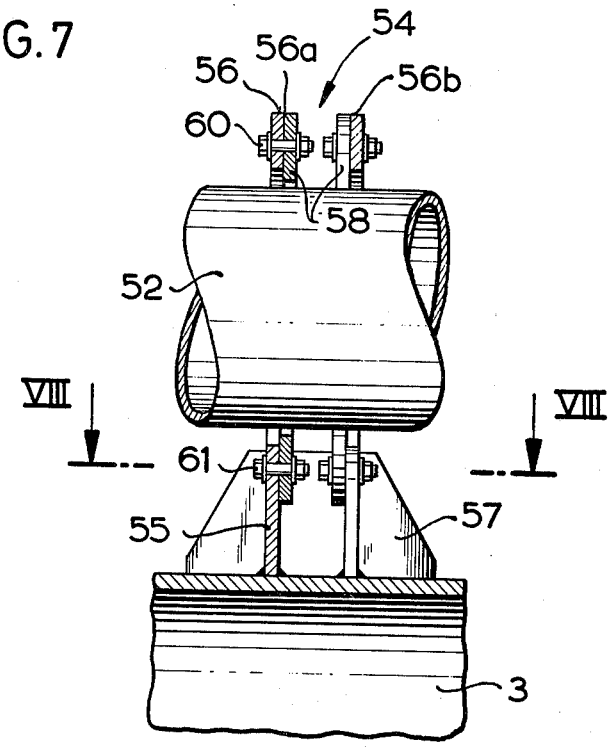
FIG. 7 is a partial cross-section substantially on line VII—VII in FIG. 8 showing a further embodiment of annular support provided by the invention for satellite cooler tubes.
Figure 8:
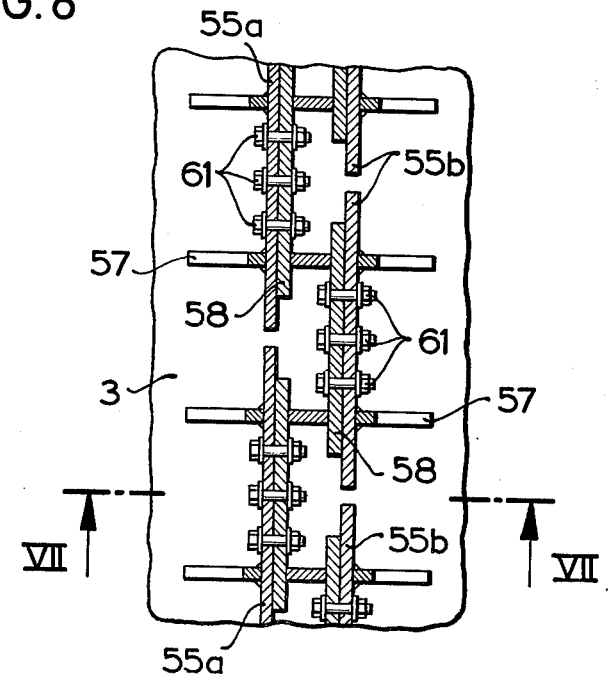
FIG. 8 is a section substantially on line VIII—VIII in FIG. 7.

One possible embodiment wherein the annular supports comprise segment-like circular elements is shown in FIGS. 7 and 8, with FIG. 7 showing a portion of support which as seen in the kiln cross-section lies generally in a plane through the longitudinal axis of satellite cooler tube and the longitudinal axis of the kiln, while FIG. 8 shows a partial plan view (line VIII—VIII in FIG. 7) of this support construction.

In this case the individual satellite cooler tubes 52 are mounted on the kiln casing 3 by annular supports 54 which in turn, seen as a whole, are formed of inner disc rings 55 and outer disc rings 56. The inner disc rings are welded directly to the outside of the kiln casing 3 (see FIG. 7). Each inner disc ring 55 consists in general of separate circular segments 55*a* and 55*b;* the ring segments 55*a* in one peripheral section of the kiln casing 3 and the ring segments 55*b* in an axially offset peripheral section of the kiln casing 3 are spaced apart from each other in the peripheral direction; and the circular segments 55*a* and 55*b* lie parallel to each other, but are offset from each other in the peripheral direction of the rotary kiln so that the segments 55*a* and 55*b* are affixed opposite each other's gaps. As seen in the kiln cross-section the adjacent ends of the corresponding annular segments 55*a* and 55*b* overlap each other, and in these overlap areas they are connected together by struts 57 aligned axially of the kiln and for example welded to the segments; and the struts in turn may be welded to the kiln casing 3. There is thus produced an inner ring structure which ensures an extremely flexible but very stable mounting of the satellite cooler tubes 52 on the kiln casing 3.

For support at the outer periphery of all satellite cooler tubes 52, the outer disc rings 56 can with advantage constitute double disc rings with the disc ring portons 56*a* and 56*b*. These disc ring portions 56*a* and 56*b* can each be formed as complete one-piece disc rings (like for instance the outer disc ring 26 in FIG. 4); however in this case the outer disc ring could also be formed, in similar manner to inner disc ring 55, of correspondingly offset ring segments joined together by struts. In each case however the connection between a satellite cooler tube 52 and the corresponding support portion will again be formed by a disc ring 58 joined by screws, 60, 61 firstly to the outer disc ring 56 and secondly to the inner disc ring 55. FIG. 7 shows that in the peripheral direction of the rotary kiln the adjacent satellite cooler tubes 52 have their corresponding disc rings 58 axially offset from each other by an amount which corresponds to the axial offset of the circular ring segments 55*a* and 55*b*. In this manner the satellite cooler tubes can be located relatively close to each other peripherally of the kiln.

The invention as explained above provides a rotary kiln design which can be adapted to any usage without constructional difficulties and at relatively low cost, while at the same time the satellite cooler tubes can be relatively easily and quickly assembled on the outlet end of the rotary kiln. Numerous further variations are obviously possible within the scope of the invention, and combination of features from the embodiments described and shown are also conceivable.

What I claim is:

1. A rotary kiln comprising a casing having an annular periphery and a plurality of substantially parallel cooler tubes uniformly distributed in a row circumferentially around the casing at its outlet end and mounted on said casing periphery by common annular support means, characterized in that said annular support means comprises radially inner and outer substantially annular zones which are flexibly connected together in the radial direction and between which are disposed said cooler tubes.

2. A rotary kiln as defined in claim 1, characterized in that zones of said annular support means are annular ring members each having a substantially rectangular cross-section.

3. A rotary kiln as defined in claim 1, characterized in that said annular support means comprises a substantially one-piece flat disc having inner and outer annular zones flexibly integrally connected by radially slotted radial struts disposed between adjacent cooler tubes.

4. A rotary kiln as defined in claim 3, characterized in that said inner and outer annular zones together with each pair of adjacent radial struts in the peripheral direction of the rotary kiln define an opening through which extends freely the corresponding satellite cooler tube, and two generally diametrically opposite projections extend between the periphery of the satellite cooler tube and the periphery of the opening.

5. A rotary kiln as defined in claim 1, characterized in that in the annular support means the inner and outer annular zones are separate coaxial rings with the outer ring surrounding the inner ring in radially spaced relation, and the satellite cooler tubes extend through and are supported in the radial gap between the rings.

6. A rotary kiln as defined in claim 5, characterized in that in said annular support means the satellite cooler tubes each have a surrounding ring spaced from the tube exterior and connected to the satellite cooler tube by projections on the tube exterior, and said surrounding ring is separately connected respectively to the inner ring and the outer ring.

7. A rotary kiln as defined in claim 6, characterized in that said surrounding rings provided on the cooler tube exterior and associated with tubes adjacent each other peripherally of the kiln are affixed alternately to one side and the other of said inner and outer rings.

8. A rotary kiln as defined in claim 1, characterized in that said support means is of circular shape.

9. A rotary kiln as defined in claim 2, characterized in that one of said annular ring members is in the form of a polygonal ring surrounding said casing.

10. A rotary kiln as defined in claim 1, characterized in that single wall plates are used for the annular support means.

11. A rotary kiln as defined in claim 1, characterized in that said annular support means comprises circumferentially spaced segment-like elements.

12. A rotary kiln as defined in claim 1, characterized in that said annular support means is of multi-wall lamellar construction.

13. A rotary kiln as defined in claim 1, characterized in that said annular support means is rigidly mounted on the rotary kiln casing.

14. A rotary kiln as defined in claim 1, characterized in that said annular support means is resiliently supported on the kiln casing.

15. A rotary kiln as defined in claim 1, wherein each said tube is resiliently mounted on said annular support means.

* * * * *